US008646755B2

(12) United States Patent
Ulgen

(10) Patent No.: US 8,646,755 B2
(45) Date of Patent: Feb. 11, 2014

(54) WILDCAT

(76) Inventor: Mehmet Nevres Ulgen, Istanbul (TR)

( * ) Notice: Subject to any disclaimer, the term of this patent is extended or adjusted under 35 U.S.C. 154(b) by 74 days.

(21) Appl. No.: 13/334,784

(22) Filed: Dec. 22, 2011

(65) Prior Publication Data

US 2013/0161580 A1 Jun. 27, 2013

(51) Int. Cl.
*B66D 1/20* (2006.01)

(52) U.S. Cl.
USPC ..... 254/358; 254/371

(58) Field of Classification Search
USPC ..... 254/221, 358, 371, 372, 407; 474/155, 474/162, 164, 204; 242/397, 397.5; D8/360
See application file for complete search history.

(56) References Cited

U.S. PATENT DOCUMENTS

| | | | | |
|---|---|---|---|---|
| 231,071 | A * | 8/1880 | McKay | 474/96 |
| 4,473,364 | A * | 9/1984 | Roling | 474/164 |
| 2003/0085392 | A1* | 5/2003 | Hsieh | 254/369 |
| 2006/0012247 | A1* | 1/2006 | Girard et al. | 305/199 |
| 2010/0006808 | A1* | 1/2010 | Weingartner et al. | 254/372 |

* cited by examiner

*Primary Examiner* — William E Dondero
*Assistant Examiner* — Nathaniel Adams

(57) ABSTRACT

A wildcat for a windlass for dropping down or hoisting an anchor for a marine vehicle, the anchor being coupled to an end of a chain (3) having inter-engaged horizontal links (5) and vertical links (6), a hole (4) formed at the center of the wildcat for engaging a shaft for rotating the wildcat (1), a bearing surface (12) being radially remote from the center of the wildcat (1) for transferring chain links (5,6) there over, horizontal link housings (7) and vertical link housings (8) each provided one after another along the bearing surface (12) for housing each respective chain link, the housings (7,8) having forms matching contours of each respective chain link.

9 Claims, 4 Drawing Sheets

WILDCAT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a wildcat (chainwheel) for a windlass used for dropping or hoisting an anchor into a marine vehicle.

In boats of ten meters or more length, the anchor weight is so great that a single person cannot pull it easily and therefore an electrical, hydraulic (or manually-driven) windlass is used to hoist the anchor into the boat. The main component of a windlass is a metal chainwheel also called a wildcat for hoisting or dropping down the chain that the anchor is connected to, or the rope, which is a pulley-like member. The wildcat is engaged to a rotating shaft from its center and when this shaft is rotated, the chain and the anchor is hoisted into or dropped down of the boat through the bearing surface.

The present invention relates to a wildcat mechanism of windlasses suitable for chained-type anchors to be hoisted into or dropped down of the boat. Anchor chain wildcats comprise indents and protrusions formed on the bearing surfaces that are covered on the chain. Therefore, when the wildcat is rotated, the chain links obtain the mechanical support sufficient for carriage through the indents and protrusions, and thus they are hoisted into the boat or released from the boat. However, as conventional metal or metal casting wildcats cannot retain the chain links properly, there emerge vibrations, leaping and noises during usage and as a result of them a great noise emerges and impact on the links is unavoidable.

The wildcat disclosed in U.S. Pat. No. 7,520,490, the entire contents of which is incorporated herein by reference, can be considered as an example of a conventional type wildcat. In FIG. 2 of U.S. Pat. No. 7,520,490, the entire contents of which is incorporated herein by reference, the indents (32) and protrusions (33) that have been formed on the bearing surface are shown. These indents and protrusions cannot retain the chain links properly and therefore causes noise and cannot prevent the links from vibrating and leaping. The wildcat disclosed in U.S. Pat. No. 7,520,490, the entire contents of which is incorporated herein by reference, has not been made of a material which can provide an ease of transfer on the chain.

BRIEF SUMMARY OF THE INVENTION

An object of the present invention is to provide an efficient wildcat.

A further object of the invention is to provide a quiet running wildcat.

The present invention relates to a wildcat for a windlass for dropping or hoisting an anchor for a marine vehicle, wherein the anchor being coupled to an end of a chain having inter-engaged horizontal links and vertical links, comprising a hole formed at the center of the wildcat for engaging a shaft to the hole for rotating the wildcat, a bearing surface being radially remote from the center of the wildcat for transferring chain links there over, horizontal link housings and vertical link housings each provided one after another along the bearing surface for housing each respective chain link, the housings having forms matching contours of each respective chain link.

Metal disc elements mutually covering preferably both side parts of the wildcat having a cylindrical body are provided. On the surfaces of the said discs facing the wildcat, there are formed protrusions to provide a metal support to the horizontal link housings.

According to a preferred embodiment of the present invention, the wildcat has a plastic hub portion and two metal lateral disc materials. Therefore, the abrasions that may emerge because of the pressure that the chain links generate decreases and therefore the noise that the chain creates while being dropped down and hoisted, and while the chain links are being borne is decreased as well.

BRIEF DESCRIPTION OF THE SEVERAL VIEWS OF THE DRAWINGS

In order for the structure and the advantages of present invention together with its additional elements to be appreciated best, it should be evaluated by considering the below-described figures.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
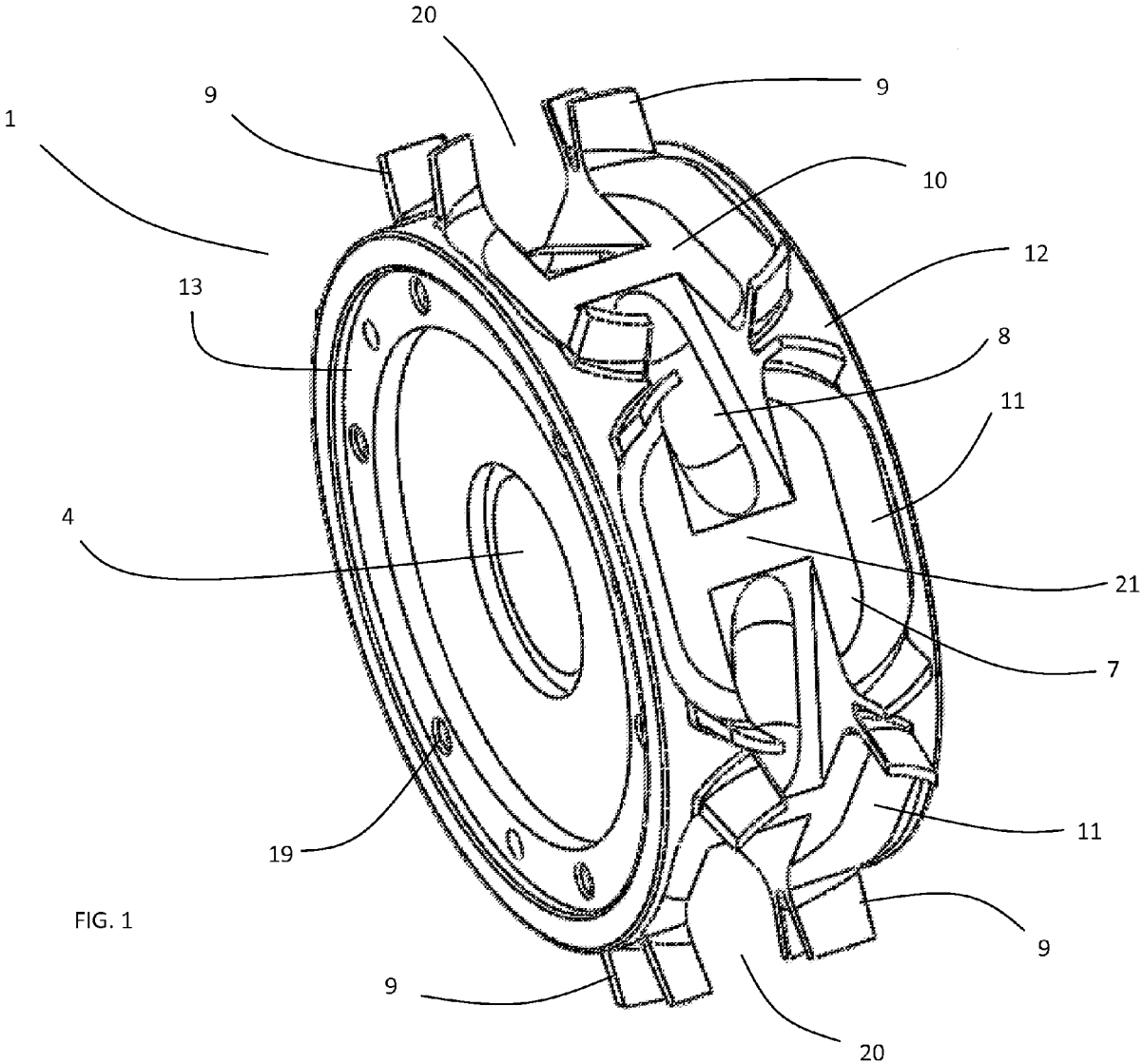
FIG. 1 is a perspective view of the wildcat according to the present invention.
Figure 2:
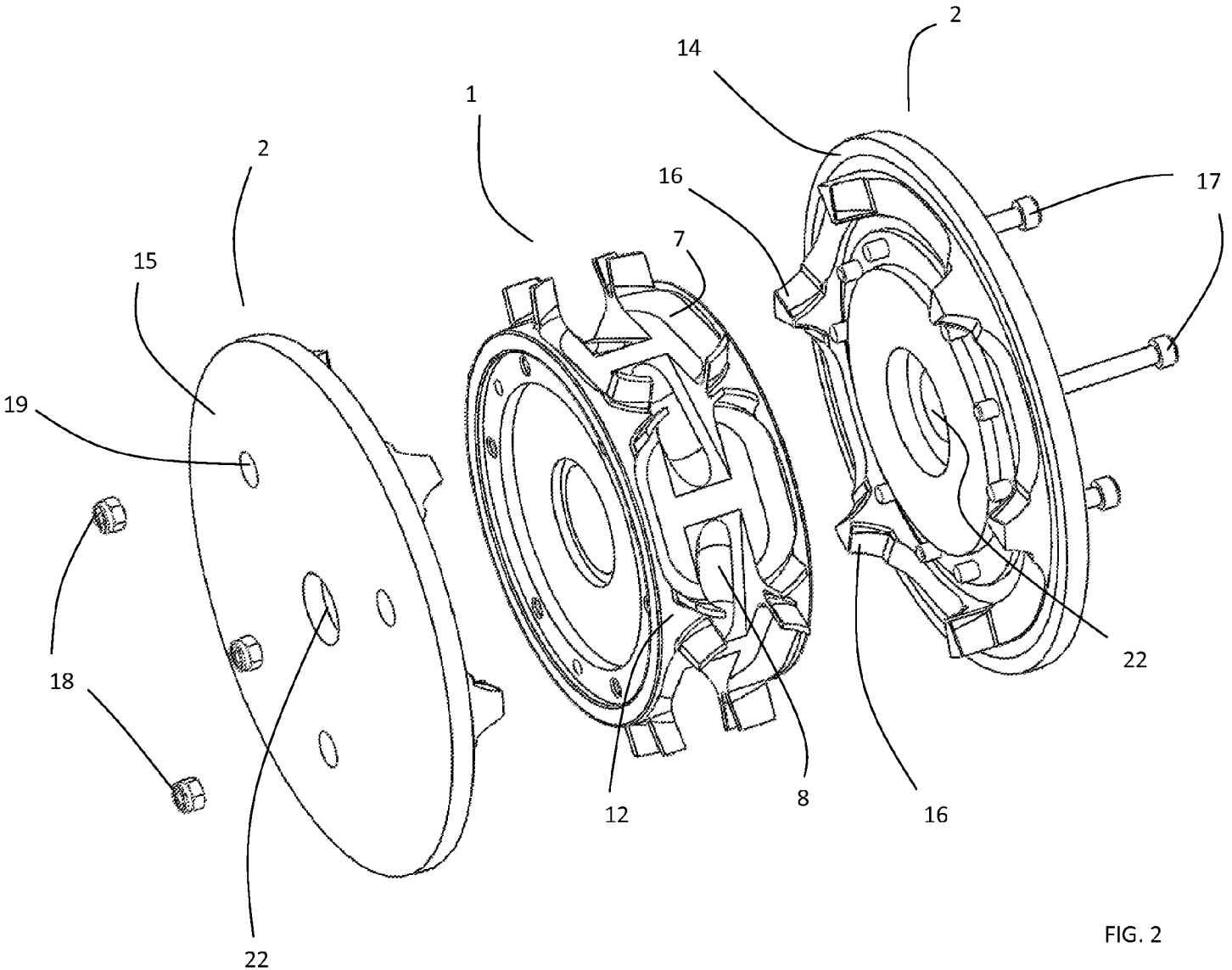
FIG. 2 is a perspective view of the wildcat according to the present invention together with the discs.
Figure 3:
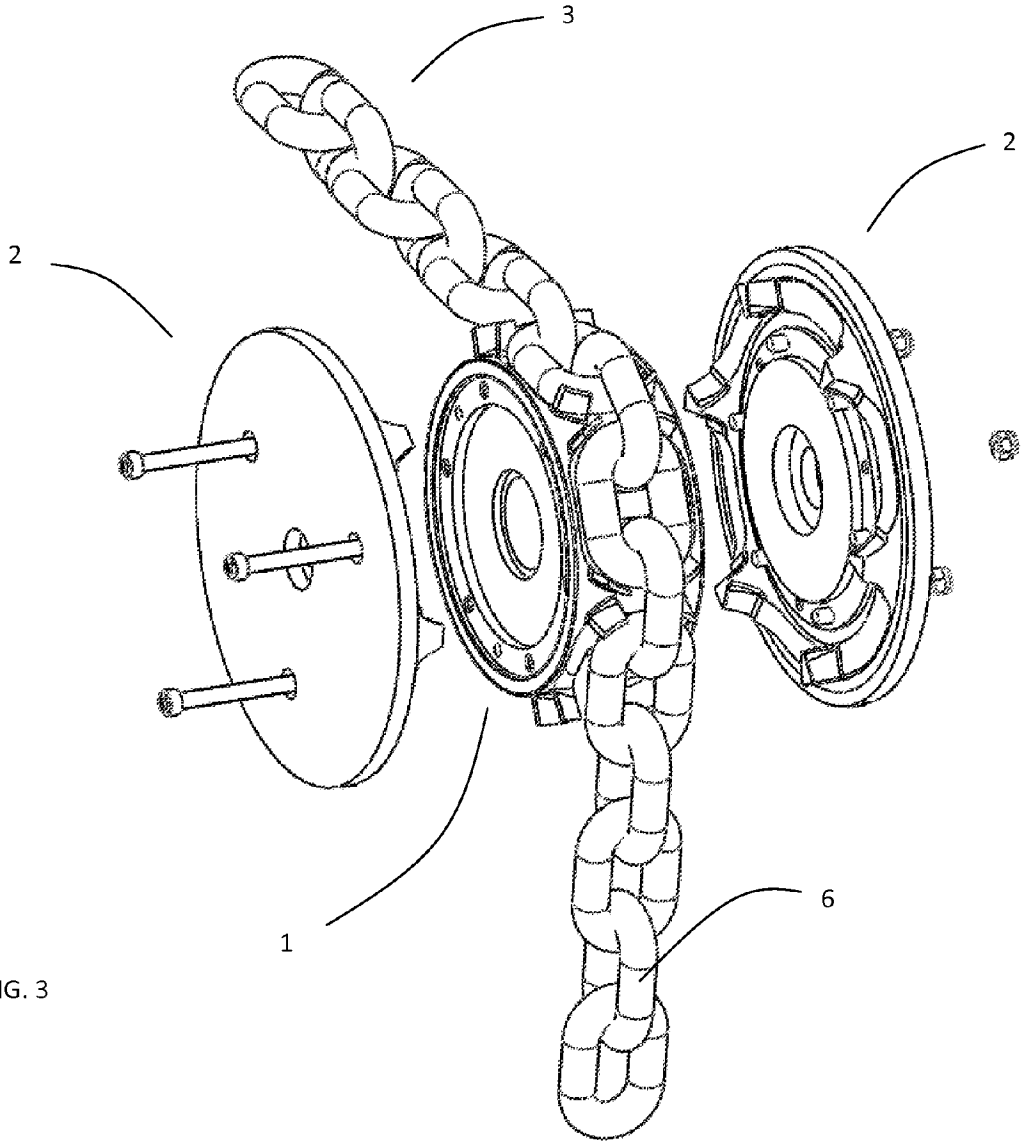
FIG. 3 is a perspective view of the wildcat together with the discs and the chain.
Figure 4:
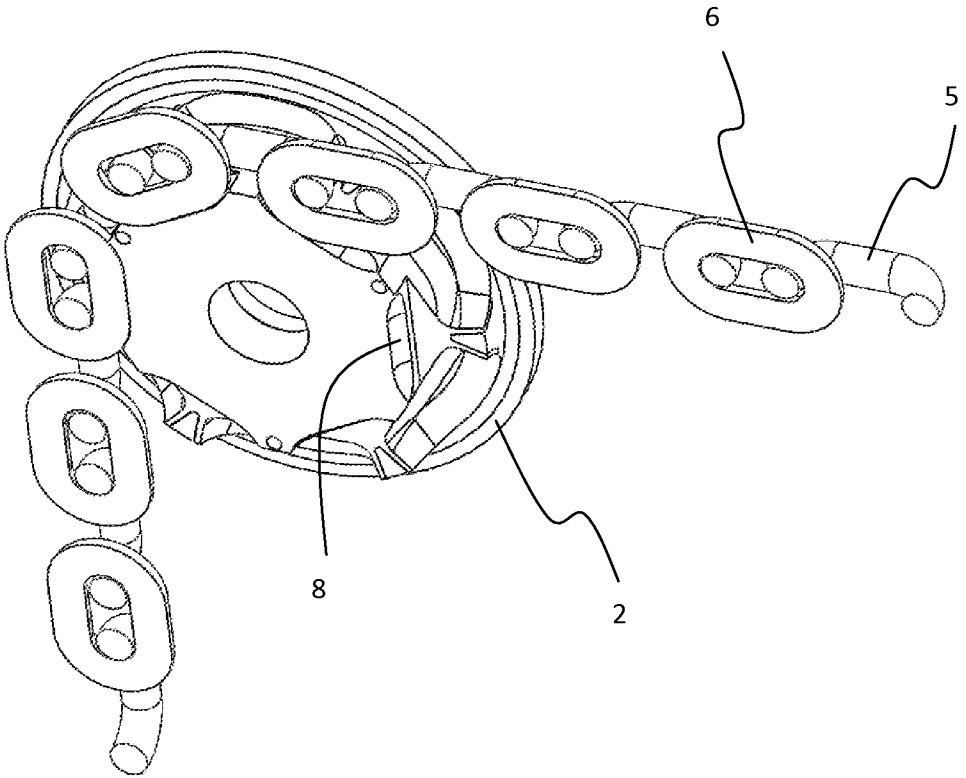
FIG. 4 is a cross-sectional perspective view of the wildcat according to the present invention.

As is shown in FIG. 1, the wildcat (1) structurally has a cylindrical form, and comprises two opposite and preferably circular metal lateral surfaces (13), and a bearing surface (12) being of a cylindrical form extending between the outer diameters of the said lateral surfaces (13) for transferring a chain there over. There is a hole (4) at the center of the wildcat (1) for a shaft to be coupled thereto, so that the wildcat (1) can be rotated by this shaft. The shaft rotating the wildcat is driven for rotation by preferably an electric motor, and it can be driven manually in the windlass arrangements where no motor is used.

On the bearing surface (12) of the wildcat (1), there are horizontal link housings (7) and vertical link housings (8) that are formed to circularly follow each outer consecutively. Therefore the links forming the chain (3) that are inter-engaged with each other extends consecutively as a horizontal link (5) and a following vertical link (6).

Each horizontal link housing (7) comprises flaps (9) extending out of the housing in the radial direction. According to a preferred embodiment of the present invention, there are four flaps (9), two of which are located oppositely for each horizontal link housing (7) on the front end of the housing, and the other two are located again oppositely on the rear end of the housing. There is a gap (20) between the flaps (9) located on the front and rear ends, because each vertical link (6) passes between the said gaps (20). Each horizontal link housing (7) comprises a base (10) extending circularly all through the bearing surface (12) of the wildcat and horizontal link housing lateral surfaces (11) extending outwards from the base (10) radially in a curved manner. The lateral surfaces (11) have a form matching with the contour of each horizontal link (5) and extend oppositely all through the bearing surface (12) of the wildcat (1). Likewise, each flap (9) has a form matching with the contour of the corners of each horizontal link (5), therefore it becomes possible for the horizontal links (5) to be fitted into the horizontal link housings (7) and supported there. By means of the flaps (9), it preserves a certain distance between the consecutive horizontal links (5).

All through the bearing surface (12) of the wildcat, each horizontal link housing (7) is followed by a vertical link housing (8). Each vertical link housing (8) has a form matching with the contour of the vertical links (6). In other words, it has a form similar to the half of a tube which has rounded ends. Thus, while the chain is being hoisted into the boat, the part of the vertical links (6) which needs to be supported (drawn) is the part which is similar to the half of a tube having rounded ends. The inter space (21) between the two consecutive vertical link housings (8) corresponds to a part of the horizontal link housing (7) base (10) between the said two vertical link housings (8). This inter space (21) preserves a certain distance between the consecutive vertical links (6).

The wildcat according to the present invention is made of preferably an engineering plastic material (such as acrylonitrile butadiene styrene (ABS), polycarbonate (PC), polyamide (PA), polybutylene terephthalate (PBT), polyethylene terephthalate (PET), polyphenylene oxide (PPO), polysulfone (PSU), polyetherketone (PEK), polyetheretherketone (PEEK), polyphenylene sulphide (PPS), polyoximethylene plastic (POM)) with lower friction coefficient and high mechanical resistance or of a combination thereof and is preferably produced as one-piece. The fact that the wildcat is made of a plastic material provides it to softly slide on the chain (3) and therefore it ensures the noise to be decreased. However, except for plastic, the wildcat can also be produced from a different but suitable metal or a composite material.

According to a preferred embodiment of the present invention, a disc (2) is provided on each opposite circular lateral surfaces (13) of the wildcat (1). Each disc (2) comprises an inner surface (14) facing the wildcat (1) and an outer surface (15) at the back of the wildcat. The inner surfaces (14) of the discs (2) include protrusions (16) provided annularly and extending onto the bearing surface (12) of the wildcat (1). These protrusions (16) are located on the inner surface (14) of each disc in such a way that when the discs (2) are closed on the lateral surfaces (13) of the wildcat (1), these protrusions (16) are neatly fitted into the inter space between the flaps (9) of two consecutive horizontal link housings (7). In other words, the flaps are the ones at the back of the front horizontal link housing (7) and the ones on the front of the following horizontal link housing. The interspaces between these flaps (9) have a V-like shape which gradually opens in the outward direction. The disc protrusions (16), on the other hand, have a V-like form tapering as they protrude towards the wildcat (1). When the disc protrusions (16) are fitted into the inter spaces between the flaps, reinforcement is provided for the horizontal links (5) to be supported. In other words, these flaps (9) are supported by these protrusions (16). Therefore, the vertical links (6) provide the horizontal links (5) to be silently fitted towards the wildcat (1).

The discs (2) may be secured to the wildcat (1) by means of bolts (17) engaged into a number of openings (19) on their surface, and by means of nuts (18) fixing the bolts. Therefore, bolt connection openings (19) are formed on the wildcat (1). Discs (2), like the wildcat (1), have a hole (22) at the center for a shaft to be engaged. The discs may be secured to the wildcat by other means as will be readily understood, including, but not limited to adhesives, rivots or welding This completes the description of the preferred and alternate embodiments of the invention. Those skilled in the art may recognize other equivalents to the specific embodiment described herein which equivalents are intended to be encompassed by the claims attached hereto.

The invention claimed is:

1. A wildcat (1) for a windlass for dropping down or hoisting an anchor for a marine vehicle, wherein the anchor being coupled to an end of a chain (3) having inter-engaged horizontal links (5) and vertical links (6), comprising a hole (4) formed at the center of the wildcat for engaging a shaft to the hole for rotating the wildcat (1), a bearing surface (12) being radially remote from the center of the wildcat (1) for transferring chain links (5,6) there over, horizontal link housings (7) and vertical link housings (8) each provided one after another along the bearing surface (12) for housing each respective chain link, the housings (7,8) having forms matching contours of each respective chain link, wherein each of the horizontal link housings (7) comprises flaps (9) extending out of the housing in a radial direction, wherein the wildcat (1) is made of a plastic material, wherein the wildcat (1) comprises lateral surfaces (13) located oppositely on each side of the bearing surface (12) and discs (2) fitted to each lateral surface (13), and wherein each of the discs (2) comprises an inner surface (14) facing the wildcat (1) and the inner surfaces (14) comprise protrusions (16) provided annularly between a pair of the flaps for supporting the flaps (9).

2. A wildcat according to claim 1, wherein two of the flaps (9) are oppositely located on the front end of each horizontal link housing (7), and two of the flaps (9) being oppositely located on the back end of each horizontal link housing (7).

3. A wildcat according claim 1, wherein gaps (20) are provided between the flaps (9) on the front end and the flaps (9) on the back ends.

4. A wildcat according to claim 1, wherein each horizontal link housing (5) comprises a base (10) extending circularly through the bearing surface (12) of the wildcat (1) and horizontal link housing lateral surfaces (11) extending radially out of the base (10) in a curved manner.

5. A wildcat according to claim 1, wherein the horizontal link housing lateral surfaces (11) and the flaps (9) have a form matching with the contour of the horizontal links (5).

6. A wildcat according to claim 1, wherein the disc protrusions (16) have a form tapering as they protrude towards the wildcat (1) for fitting into the gaps (20) between the flaps (9) for support thereof.

7. A wildcat according to claim 1, wherein the plastic material is an engineering plastic material.

8. A wildcat according to claim 7, wherein the engineering plastic material is selected from the group consisting of acrylonitrile butadiene styrene (ABS), polycarbonate (PC), polyamide (PA), polybutylene terephthalate (PBT), polyethylene terephthalate (PET), polyphenylene oxide (PPO), polysulfone (PSU), polyetherketone (PEK), polyetheretherketone (PEEK), polyphenylene sulphide (PPS), polyoximethylene plastic (POM).

9. A wildcat (1) for a windlass for dropping down or hoisting an anchor for a marine vehicle, wherein the anchor being coupled to an end of a chain (3) having inter-engaged horizontal links (5) and vertical links (6), comprising a hole (4) formed at the center of the wildcat for engaging a shaft to the hole for rotating the wildcat (1), a bearing surface (12) being radially remote from the center of the wildcat (1) for transferring chain links (5,6) there over, horizontal link housings (7) and vertical link housings (8) each provided one after another along the bearing surface (12) for housing each respective chain link, the housings (7,8) having forms matching contours of each respective chain link, wherein each of the horizontal link housings (7) comprise flaps (9) extending out of the housing in a radial direction, wherein two of the flaps (9) are oppositely located on the front end of each horizontal link housing (7), and two of the flaps (9) being oppositely located on the back end of each horizontal link housing (7), and said wildcat further comprises gaps in V-shape form gradually opening in an outward direction that are between the flaps (9) on the back end of the horizontal link housing (7) and the flaps (9) on the front end of the following horizontal link housing.

* * * * *